United States Patent [19]

Gretz

[11] 4,048,051

[45] Sept. 13, 1977

[54] BOX WITH CHILD RESISTANT CLOSURE

[75] Inventor: Charles Gretz, Calabasas, Calif.

[73] Assignee: Nutrilite Products, Inc., Buena Park, Calif.

[21] Appl. No.: 753,095

[22] Filed: Dec. 21, 1976

[51] Int. Cl.[2] ..... A45C 13/10; A45C 13/18

[52] U.S. Cl. ..... 206/1.5; 220/324

[58] Field of Search ..... 206/1.5, 235; 220/324, 220/346

[56] References Cited

U.S. PATENT DOCUMENTS

| | | | |
|---|---|---|---|
| 2,800,220 | 7/1957 | Hawker | 206/1.5 |
| 3,360,644 | 12/1967 | Lillelostad | 220/324 X |

*Primary Examiner*—George T. Hall

*Attorney, Agent, or Firm*—Burns, Doane, Swecker & Mathis

[57] ABSTRACT

A container for pharmaceutical preparations such as tablets, capsules and the like is provided with a safety closure that is difficult for children to open yet is easily opened by adults. The safety closure includes a slide, guides and a slide detent. The container may have a base and a hingedly attached lid with the guides provided on both the lid and the base. To releasably maintain the lid in a closed position, the slide is carried by one of the guides and selectively engages another guide. The slide detent may include a finger which retains the slide closure in engagement with the guides until the finger is depressed. A latch may be provided to releasably maintain the lid in the closed position when the slide does not engage the guides. The slide both conceals and prevents operation of the latch. By maintaining symmetry in the safety closure region of the container, operation of the detent is further concealed from discovery by children.

11 Claims, 5 Drawing Figures

Fig. 1
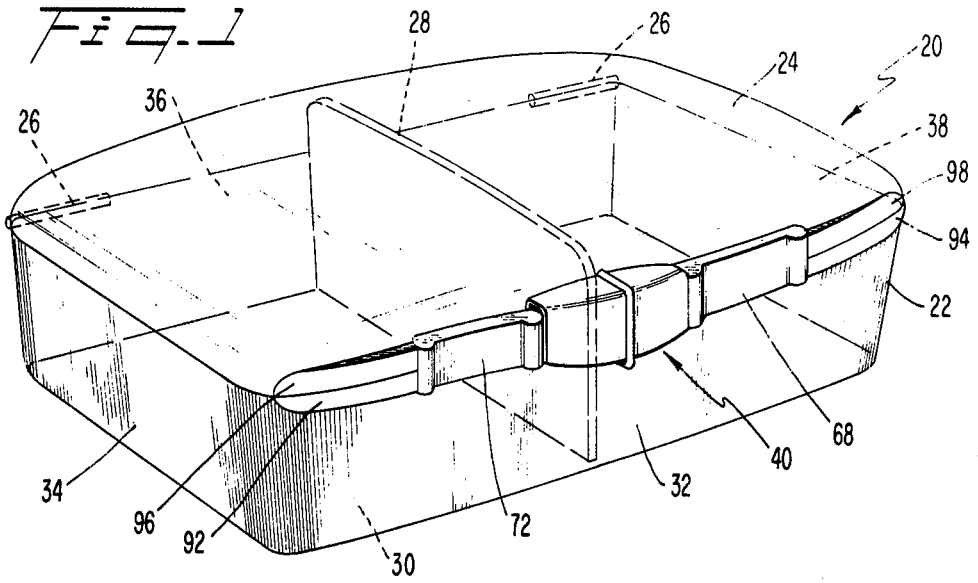
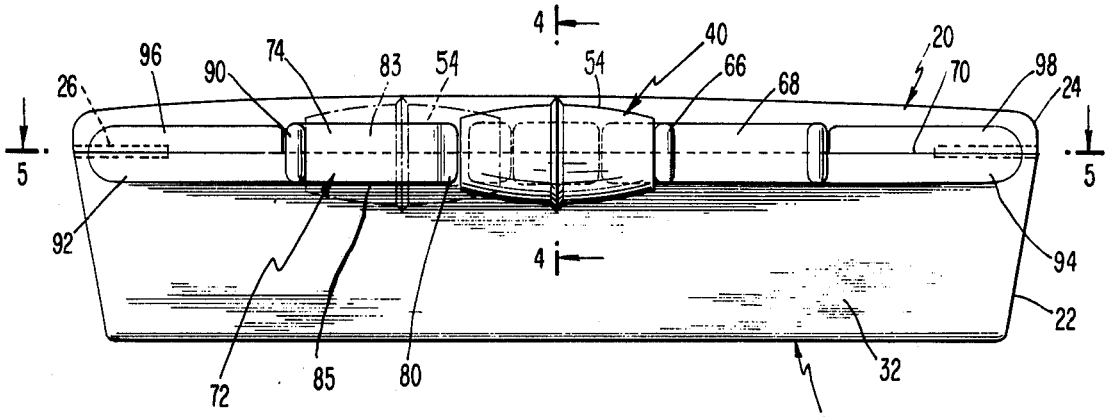
Fig. 2
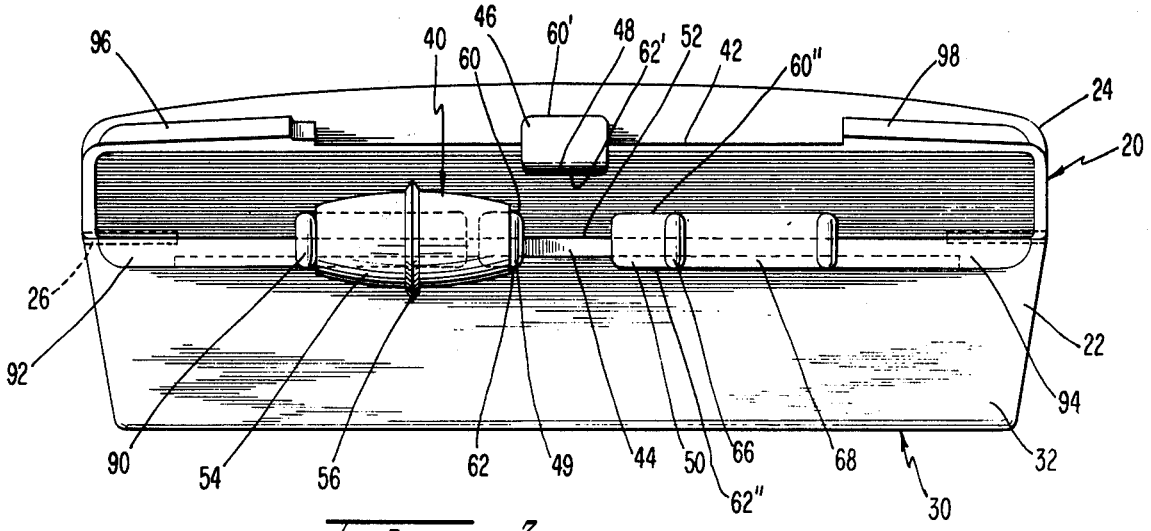
Fig 3

BOX WITH CHILD RESISTANT CLOSURE

BACKGROUND OF THE PRESENT INVENTION

The present invention relates generally to a container for small objects which is provided with a closure device. More specifically, this invention concerns a container for pharmaceutical preparations having a safety closure which is difficult for a child to open while being easily opened by an adult.

Despite attempts to keep dangerous pharmaceutical preparations such as tablets, capsules and the like out of reach of young children, numerous young children suffer accidental poisoning from pharmaceutical preparations each year. To help prevent these accidental poisonings, pharmaceutical manufacturers now make widespread use of containers having "child proof" closures. However, the known containers suitable for storing pharmaceutical preparations typically are either too easy or too difficult to open. If the container is too easy to open, a small child is often able to gain access to the dangerous preparations after only a few attempts. Conversely, if the container is too difficult to open, many adults will simply refuse to use the container, thereby exposing children to a risk of accidental poisoning.

Some containers for pills having a "child proof" safety closure utilize a detent assembly to prevent the movement of a lid until a portion of the detent mechanism is depressed, as illustrated in U.S. Pat. No. 3,782,584 issued to Swenson et al. Containers of this general type may include a sliding lid cover which, when opened, moves a short distance to reveal a single row of tablets. However, a safety closure of such a container requires depression of an exposed retention member and coordinated lid movement to effect release of the safety closure. As a child is likely to see the exposed retention member and to attempt moving a lid to gain access, this container closure is also deficient.

Earlier attempts at providing a hinged container having a "child proof" closure have generally utilized a sequential or simultaneous application of pressure to various sections of the container to phyically open the container. For example, one hinged container requires simultaneous application of pressure to two corners of the container above a hinge to open the container, as illustrated in U.S. Pat. No. 3,894,655 issued to Mattheis et al. When released, however, this safety closure completely opens the container, and does not provide an intermediate step in which the safety closure is released and the container is still closed. Since mere application of pressure effects release of the lid, a child may fortuitously cause opening of the lid and gain access to the container contents.

In some instances, it is desirable to have a single container provided with two or more compartments, each of which receives a different pharmaceutical preparation. Where it is necessary to have one of each different pharmaceutical preparations for proper dosage, those prior art containers giving partial access to the interior are further insufficient.

In view of the deficiencies in the known "child proof" safety closures briefly outlined above, as well as numerous others, it is apparent that the need continues to exist for a truly effective safety closure the operation of which is not likely to be accidentally discovered and which requires the manipulation of a latch that frustrates attempted opening by a child.

SUMMARY OF THE INVENTION

A container which overcomes the deficiencies noted above, as well as many others, includes a lid portion and a base portion which are movable between a closed configuration in which an enclosed compartment is defined and an open configuration in which there is access to the compartment. The lid portion and the base portion are secured in the closed configuration by a latching means which is releasable. The latching means is concealed by a slide closure means carried by the container portions which is slidable between a first position that conceals the latching means and a second position that allows the latching means to be released. A detent means is provided on one of the portions and operates to releasably maintain the slide closure means in the first position.

The appearance of the container is preferably designed to be symmetrical so that operation of the slide closure means will not be readily apparent to a young child.

The latching means may include a latching portion connected to the lid portion which cooperates with a protrusion of the base portion so as to latch the lid portion to the base portion regardless of the position of the slide closure means. In this manner, the lid portion and base portion will not open should a child inadvertently discover the operation of the slide closure means.

In order to effectively conceal the latching means, the latch portion may be located on a slide closure guide which extends downwardly from the lid portion toward the base portion. Another slide closure guide extending upwardly from the base portion toward the lid portion is in general longitudinal alignment with the first slide closure guide when the container is in the closed configuration. In this manner, a slide closure can be slid to the first position where it covers both the slide closure guides.

To prevent the inadvertent separation of the slide closure from the container when the container is in the open configuration, the slide closure is preferably designed to move onto the detent means and be retained thereby when moved to the second position.

BRIEF DESCRIPTION OF THE DRAWINGS

Many objects and advantages of the present invention will be apparent to those skilled in the art when this specification is read in conjunction with the drawings wherein like elements bear like reference numerals and wherein:

FIG. 1 is a pictorial view of a container according to the present invention;

FIG. 2 is a front elevation of the container in a closed configuration showing the two positions of the slide closure;

DESCRIPTION OF THE PREFERRED EMBODIMENT

Figure 3:
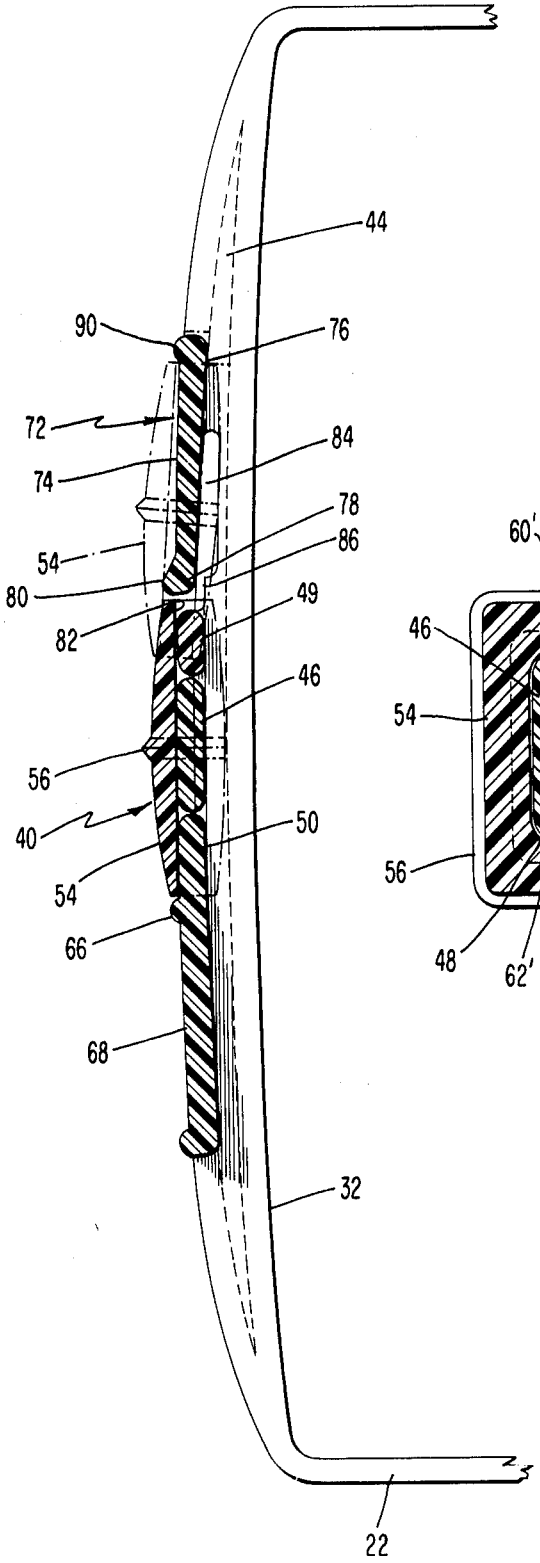
FIG. 3 is a front elevation of the container in an open configuration.

In reference to FIG. 1, the preferred embodiment of the container 20 includes a base portion 22 and a lid portion 24 which may be hingedly connected to one another by a hinge 26. A safety closure 40 is provided at the front of the container 20 to releasably retain the lid portion 24 and the base portion 22 in a closed configuration. The base portion 22 includes a generally flat bottom member 30 which may be generally rectangular as illustrated. In addition, the base portion 22 also includes four wall members 32, 34, 36 and 38, each of which extends upwardly from a corresponding edge of the bottom member 30. The base member 30 and the four wall members 32, 34, 36 and 38 are joined together along their adjacent edges to define a boxlike structure having an open top.

The base portion 22 may include a generally upstanding dividing wall 28 which extends between front and rear wall members 32, 36 so as to divide the base portion 22 into a pair of compartments. The dividing wall 28 is suitably connected along its edges to the adjacent wall members 32, 36 and the bottom member 30. Each of the compartments defined in the base portion 22 is adapted to receive one or more small objects that may, for example, be pharmaceutical preparations such as tablets, capsules and the like or other substances which pose a hazard to children. Moreover, each compartment may contain a different pharmaceutical preparation so that, by opening the hinged lid portion, both preparations are readily available.

The lid portion 24, in the closed configuration, cooperates with the base portion 22 such that the two compartments are enclosed. Extending outwardly from a forward edge of the lid portion 24 (see FIG. 3) is a flangelike lip 42. A second flangelike lip 44 extends outwardly from the upstanding front wall 32 of the base portion 20 and abuts the lip 42 when the lid portion is in the closed configuration (see FIG. 2).

Positioned symmetrically at the center of the lip 42 (FIG. 3) is a member 46 which extends vertically above and below the lip 42 and which is provided with a latching portion 48 at the distal end thereof (see FIG. 4). The latching portion 48 extends below the lip 44 and cooperates with the lip 44 to define a latch means which retains the lid portion 24 and the base portion 22 in the closed configuration. The latch portion 48 may comprise a generally horizontal, inwardly projecting rib 88 which cooperates with the protruding lip 44 to provide a pair of interfering protrusions that restrict relative movement of the lid portion 24 and the base portion 22 about the hinge. By deflecting the latch portion 48 outwardly, the rib 88 will clear the lip 44 and permit opening of the container.

The slide closure means 40 (see FIG. 2) is provided to conceal the latching means when the container is in the closed configuration. The slide closure means 40 includes a first slide closure guide 49 (see FIG. 3) and a second slide closure guide which is also the vertically extending member 46. The first slide closure guide 49 is carried by the lip 44 of the base portion 22 and extends vertically above and below the lip 44. A third slide closure guide 50 is also provided on the lip 44 and extends above and below the lip 44. The third guide 50 is spaced from the first guide 49 by a distance sufficient to accommodate the width of the second guide 46. In this manner, when the lid portion 24 and the base portion 22 are in the closed configuration (see FIG. 2), the first, second and third slide closure guides 49, 46, 50 are in general longitudinal alignment along a parting line 70.

Figure 4:
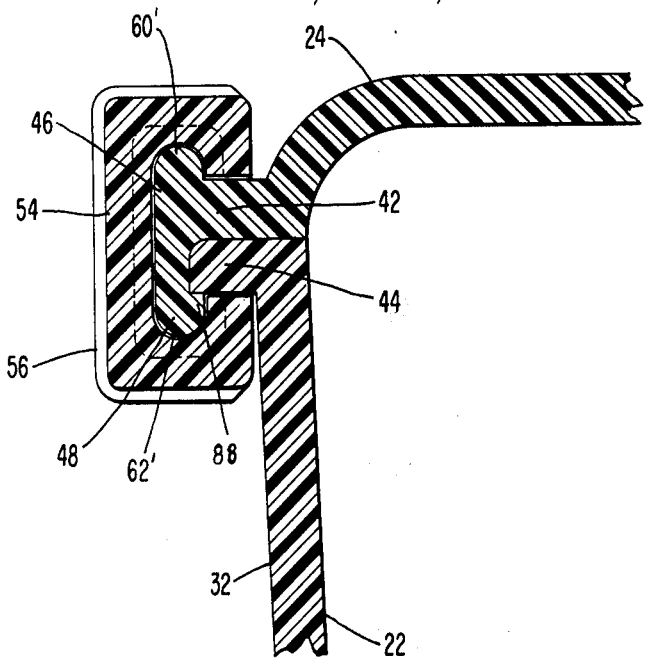
FIG. 4 is an enlarged cross-sectional view taken along the line 4—4 of FIG. 2; and, FIG. 5 is a cross-sectional view taken along the line 5—5 of FIG. 2.

The slide closure means 40 also includes a slide closure member 54 which has a C-shaped cross section (see FIG. 4) and an outwardly projecting, medially positioned ridge 56 (see FIG. 3). The ridge 56 contributes to the symmetric appearance of the container in the closed configuration (see FIG. 2) and facilitates movement of the slide closure 54 by a person opening the container. The slide closure 54 is slidable between a first position and a second position illustrated by the phantom lines 58. The second position is illustrated in solid lines in FIG. 3.

Each of the slide closure guides 49, 46, 50 is provided with an upper rail portion 60, 60′, 60″ and a lower rail portion 62, 62′, 62″. Each upper rail portion 60, 60′, 60″ extends above the lip 42 of the lid 24; similarly, each lower rail portion 62, 62′, 62″ extends below the lip portion 44. When the lid portion 24 and the base portion 22 are in the closed configuration (see FIG. 2), the upper rail portions 60, 60′, 60″ are aligned and the lower rail portions 62, 62′, 62″ are aligned. In this manner, the C-shaped cross-sectional configuration of the slide closure 54 can be retained on the slide closure guides and guided thereby so as to be restrained to longitudinal sliding movement with respect thereto.

In order to positively limit movement of the slide closure 54 to the right (see FIG. 2) and to define the first position, the lip 44 of the base portion 22 is provided with a forwardly extending protrusion 66. The protrusion 66 is carried by a flange 68 which extends above and below the lip 44 to conceal a section of the parting line 70 between the lid portion 24 and the base portion 22. The flange 68 has upper and lower edges which are aligned respectively with the upper and lower guide rails 60″, 62″.

The slide closure 54 is held in the first position by a releasable detent means 72 which may comprise a finger 74 (see FIG. 5) having a base 76 which is connected to the lip 44. The finger 74 also includes a distal end 78 having a forwardly projecting protrusion 80 that is positioned closely adjacent the slide closure member 54 in the first position. The protrusion 80 extends forwardly beyond the inside surface 82 on the slide closure member 54 and must be repositioned in order to allow movement of the slide closure member 54 to the second position.

Turning briefly to FIG. 2, it will be observed that the finger 74 extends above and below the lip 44 to cover a section of the parting line 70, as does the flange 68. In addition, the finger 74 with the forwardly extending protrusion 80 and the flange 68 with the forwarding extending protrusion 66 are symmetrically located above the center of the container. Moreover, an upper edge 83 of the finger aligns with the upper guide rail 60 and a lower edge 85 of the finger aligns with the lower guide rail 62.

The finger 74 (see FIG. 5) extends in a cantilever fashion from the base 76 and overlies an elongated slot 84 provided in the lip 44. The length of the slot 84 may be selected as desired and determines the amount of force which must be exerted to deflect the finger 74. Deflection of the finger 74 is limited by an abutment surface 86 which is provided at an end of the slot 84 adjacent to the distal end 78 of the finger 74.

When the distal end 78 of the finger 74 is depressed into engagement with the abutment surface 86, the slide closure member 54 may be slidably moved from the first position, shown in FIG. 5, to the second position, shown in FIG. 2. During this movement of the slide closure member 54, the slide closure member is guided by alignment of upper rails 60, 60′, 60″ and the upper edge 83 and by alignent of lower rails 62, 62′, 62″ and the lower edge 85. Thus, the slide closure member slides onto the finger 74 and can be moved until the closure member 54 comes into abutting engagement with a forwardly extending protrusion 90 positioned at the base of the finger 74. In this position, the slide closure member 54 is retained by the finger 74 and the first slide closure guide 49. Resiliency of the deflected finger 74 will push the protrusion 80 into engagement with the inner surface 82 of the slide member 54, thereby frictionally retaining the slide member 54 against inadvertent loss.

Each end of the lip 44 (see FIG. 2) is provided with a downwardly extending flange 92, 94. Each end of the lid portion 24 is provided with similar upwardly extending flange portion 96, 98. The downwardly extending flange portions 92, 94 are symmetrically disposed with respect to the center line of the container 20; similarly, the upwardly extending flanges 96, 98 are also symmetrically disposed. The upwardly extending flanges 96, 98 are each spaced along the lip 42 (see FIG. 3) of the lid portion 24 by a distance sufficient to accommodate the first slide closure guide 49, the finger 74, and the forwardly extending abutment protrusion 90.

In operation, with the container 20 in the closed configuration (see FIG. 2), the distal end of the finger 74 is depressed toward the abutment surface 86 (see FIG. 5) and held in the depressed configuration while the slide closure member 54 (see FIG. 2) is slid from its first position toward its second position.

As the slide closure member moves from the first position to the second position, it slides upon the depressed finger 74 and uncovers the third slide closure guide 50 (see FIG. 3). Continued movement of the slide closure member 54 uncovers the second slide closure guide 46 to reveal the latch portion 48. When the slide closure member 54 comes into abutment with the forwardly extending protrusion 90 at a base of the finger 74, the slide closure member is supported and retained by the first slide closure guide 49 and by the finger 74.

With the slide closure member in the second or retracted position, the latch means is exposed and the latch portion 48 may be engaged and deflected forwardly so that it clears the forwardly extending lip 44 of the base portion 22. The lid portion and the base portion 22 may then be separated to the open configuration to allow access to the compartments and contents thereof.

Closure of the lid portion 24 with respect to the base portion 22 is effected by substantially reversing the steps outlined above. However, it should be noted that the closing procedure is not an exact reversal of the opening procedure since the distal end of the finger 74 need not be depressed in order for the closure procedure to be performed.

In the closed configuration a container constructed in accordance with the present invention has a symmetrical appearance which makes it more difficult for a young child to determine the necessary sequence of steps to effect an opening of the container. Moreover, the container is readily opened by adults since the slide closure may be rapidly actuated to expose the latch means.

It will also be noted that the parting line 70 between the lid portion 24 and the base portion 22 is concealed by the safety closure assembly for a substantial portion of its length. This concealment is further helpful to deter accidental access to the container contents by a young child.

Still further, if the container is used to store two varieties of pharmaceutical preparations, the hinged construction permits simultaneous access when a single safety closure has been opened.

The container of the present invention may be fashioned from any suitable conventional material including clear synthetic resinous materials, opaque synthetic resinous materials, and any other suitable material that may be desired for a particular application. Moreover, the container with the safety closure can be fashioned as an integral structure by suitable conventional molding techniques, as desired.

It should now be apparent that there has been provided in accordance with the present invention a container having a safety closure which is readily opened by adults but which is quite difficult for young children to open. Moreover, it will apparent to those skilled in the art that numerous modifications, variations, substitutions and equivalents may be made for the features of the invention without departing from the spirit and the scope of the invention. Accordingly, it is expressly intended that all such modifications, variations, substitutions and equivalents which fall within the spirit and scope of the invention is defined in the appended claims being embraced thereby.

What is claimed is:

1. A container suitale for holding one or more small objects comprising:

first and second container portions movable between an open configuration and a closed configuration, the first and second container portions cooperating in the closed configuration to define a compartment;

latching means provided on the container portions, operable to releasably maintain the first and second container portions in the closed configuration;

slide closure means provided on the container portions and operable to slide between a first position and a second position while the container portions are in the closed configuration, in the first position the slide closure means prevents release of the latching means and in the second position the slide closure means permits release of the latching means; and detent means provided on one of the container portions operable to releasably maintain the slide closure means in the first position.

2. The container of claim 1 wherein the slide closure means includes a first slide closure guide on the first container portion, a second slide closure guide on the second container portion, and a slide closure carried by one of the first and second slide closure guides and being operable to engage the first and second slide closure guides when the slide closure means is in the first position.

3. The container of claim 1 wherein the latching means includes a first latch portion provided on the first container portion and a second latch portion provided on the second container portion, the first and second latch portions operable to releasably engage one another when the container portions are in the closed configuration.

4. The container of claim 1 wherein the detent means includes a finger having a base attached to one of the container portions and a distal end located in proximity to the slide closure means so as to interfere with sliding movement of the slide closure means when the slide closure means is in the first position.

5. The container of claim 1 wherein the first and second container portions are hingedly attached to one another.

6. In a container suitable for holding one or more small articles such as tablets, capsules and the like, the container including first and second hingedly connected container portions movable between an open configuration and a closed configuration, the portions cooperating with one another in the closed configuration to define an article receiving compartment, the improvement comprising a safety closure including:

latching means on the first and second container portions operable to releasably maintain the first and second container portions in the closed configuration;

slide closure means provided on the container portions and operable between a first position and a second position while the container portions are in the closed configuration, the slide closure means being operable to prevent release of the latching means in the first position and operable to allow release of the latching means in the second position; and detent means provided on one of the first and second container portions, operable to releasably retain the slide closure means in the first position.

7. The container as recited in claim 6 wherein the slide closure means includes a first slide closure guide on the first container portion, a second slide closure guide on the second container portion, and a slide closure slidable between the first and second position, carried by the first slide closure guide when the slide closure is in the second position and engaging both the first and second slide closure guides when in the first position.

8. The container of claim 7 further including a thid slide closure guide on the first container portion, spaced from the first slide closure guide by a distance sufficient to allow the second slide closure guide to be positioned therebetween, and engaged by the slide closure when in the first position to conceal the second slide closure guide.

9. The container of claim 8 wherein the latching means includes a latch portion at the free end of the second slide closure guide and a cooperating protrusion of the first container portion, the latch portion and the cooperating protrusion being concealed by the slide closure in the first position.

10. The container of claim 6 wherein the detent means includes a finger having a base attached to one of the container portions and a distal end located in proximity to the slide closure means so as to interfere with sliding movement of the slide closure means.

11. A container suitable for holding one or more small objects such as tablets, capsules and the like comprising:

a base portion including a bottom member and four wall members, the bottom and wall members being joined to one another to define a receptacle;

a lid portion hingedly attached to the base portion and movable with respect to the base between an open configuration and a closed configuration, the lid portion and base portion cooperating with one another when the lid portion is in the closed configuration to define an object receiving compartment;

an upper slide closure guide attached to the lid portion, the upper slide closure guide having a first latch portion including a horizontal ridge at a free end of the first latch portion, the first latch portion being operable to releasably engage a protrusion of the base portion to retain the lid portion in the closed configuration;

first and second lower slide closure guides attached to one of the wall members and separated from each other so that the upper slide closure guide may be positioned therebetween when the lid portion is in the closed configuration;

a detent finger having a base attached to one wall member of the base portion such that a distal end is positioned adjacent to the first lower slide closure guide, the distal end being movable into general longitudinal alignment with the first slide closure guide; and a slide closure carried by the first lower slide closure guide and being operable between a first position and a second position while the lid portion is in the closed configuration, in the first position the slide closure engages the upper and both lower slide closure guides to cover the first latch portion and make the latch portion inaccessible, in the second position the slide closure is supported by the first lower slide closure guide and the detent finger in the longitudinally aligned relationship.

* * * * *